US007337909B1

(12) United States Patent
Morgan

(10) Patent No.: US 7,337,909 B1
(45) Date of Patent: Mar. 4, 2008

(54) ADVERTISING/PROMOTIONAL DISPLAY AND/OR STORAGE SYSTEM

(75) Inventor: Elizabeth J. Morgan, East Lyme, CT (US)

(73) Assignee: Structural Graphics, LLC, Essex, CT (US)

( * ) Notice: Subject to any disclaimer, the term of this patent is extended or adjusted under 35 U.S.C. 154(b) by 535 days.

(21) Appl. No.: 10/882,962

(22) Filed: Jul. 1, 2004

Related U.S. Application Data

(60) Provisional application No. 60/485,029, filed on Jul. 3, 2003.

(51) Int. Cl.
*B65D 5/50* (2006.01)

(52) U.S. Cl. ..... 206/736; 206/745; 206/750; 229/117.01

(58) Field of Classification Search ..... 206/736, 206/740, 745, 750, 756, 743, 747, 749, 764; 229/117.01, 120.31, 117.03, 117.04, 117.05, 229/117
See application file for complete search history.

(56) References Cited

U.S. PATENT DOCUMENTS 1,907,716 A 5/1933 Berkowitz
1,959,619 A 5/1934 Ebert
2,998,179 A * 8/1961 Zilles ..... 229/120.18
3,815,808 A * 6/1974 Bunnell ..... 206/427
3,843,039 A * 10/1974 Brown et al. ..... 229/120.31
4,105,154 A * 8/1978 Meyers et al. ..... 229/120.06
4,313,270 A 2/1982 Volkert et al.
4,313,554 A * 2/1982 Montealegre ..... 229/120.18
4,671,450 A * 6/1987 Lopez ..... 229/120.17
4,885,859 A 12/1989 Gasser
4,949,482 A 8/1990 Price
5,564,208 A 10/1996 Bergman
5,611,425 A * 3/1997 Holley, Jr. ..... 206/144
5,839,650 A * 11/1998 Sheffer ..... 229/120.11
6,168,013 B1 * 1/2001 Gomes ..... 206/162

* cited by examiner

*Primary Examiner*—Mickey Yu
*Assistant Examiner*—Steven A. Reynolds
(74) *Attorney, Agent, or Firm*—Melvin I. Stoltz

(57) ABSTRACT

By providing a pre-printed housing member which is shipped or stored in a completely folded, flat configuration and quickly and easily erected from its flat, generally two-dimensional configuration into a three-dimensional promotional display and product holding or storing member, a printed, visually exciting and interest-generating, easily erected advertising/promotional display and storage system is obtained. In one embodiment, multiple compartments are integrally formed and automatically created during the erection process, thereby enabling a plurality of different materials to be placed in the display/storage system. In a second embodiment, a plurality of stackable and interchangeable members are created, thereby achieving a multi-tiered storage system, for any desired products or items.

17 Claims, 7 Drawing Sheets

20
24
38
36
42
25
43
30
21
35
37
41
40
23
22
44

ADVERTISING/PROMOTIONAL DISPLAY AND/OR STORAGE SYSTEM

RELATED APPLICATIONS

This application is related to U.S. Provisional Patent Application Ser. No. 60/485,029, filed Jul. 3, 2003 entitled MULTI-COMPARTMENT, ADVERTISING/PROMOTIONAL DISPLAY SYSTEM.

TECHNICAL FIELD

This invention relates to advertising/promotional display and/or storage systems and, more particularly, to advertising/promotional display and/or storage systems which are movable between a substantially flat configuration and an erectable three-dimensional holding system.

BACKGROUND ART

With the ever increasing quantity of products and services being offered to consumers, substantial interest has been given to promotional display systems for advertising such products and services. In this regard, a wide variety of advertising displays and promotional literature has been created and distributed to consumers. However, due to the deluge of material to which average consumers are constantly exposed, greater emphasis has been placed upon developing eye-catching, visual displays and promotional material which will receive consumer attention, while also being easily transported and constructed for use.

Although various novelty products and printed displays have been created in an attempt to satisfy this demand, these prior art products have failed to provide the desired interest generating result with production costs which advertisers are capable of justifying. In attempting to generate a unique advertising display, some prior art products have employed complex folding systems which produce a three-dimensional display when unfolded or erected. However, in spite of the unique visual appearance generated by such products, the overall cost of production and complexity of assembly of these systems has prevented such prior art systems from becoming popular.

Other prior art displays have attempted to generate consumer interest by providing unique visual images or other indicia as an integral part of the display. However, these prior art attempts have also failed to generate the interest being sought, largely due to an inability to achieve an easily erected and employed product, which remains completely flat when folded.

In addition, a further area in which prior art products have failed to satisfy the needs of the users is the storage of small items. Whether these items are for display in a retail establishment or for storage of products or items to be given to individuals, the need for a storage/display system has long existed. In particular, prior art products have failed to provide a storage/display system which is capable of being folded into a completely flat configuration, when not in use, and then quickly and easily fully erected into a storage/display container for receiving, holding, and displaying any particular items to be retained therein.

A further problem which has continuously plagued prior art constructions is the area occupied by such prior art systems when fully erected. In this regard, most users have a minimum of space for positioning a storage/display container. However, the prior art products generally require substantially greater space or area than a consumer has available.

Therefore, it is a principal object of the present invention to provide a printed advertising, promotional, display, or storage system which is capable of being produced at a reasonable cost and provides an exciting, interest-generating display and/or a storage system.

Another object of the present invention is to provide a printed advertising, promotional, display, or storage system having the characteristic features described above, which enables the user to quickly and easily erect the display/storage system.

Another object of the present invention is to provide a printed advertising, promotional, display, or storage system having the characteristic features described above which is capable of mass production and assembly.

A further object of the present invention is to provide a printed advertising, promotional, display, or storage system having the characteristic features described above which provides a unique, eye-catching, exciting display which is shippable in a completely flat configuration and erectable into a three-dimensional holding system.

Another object of the present invention is to provide a printed advertising, promotional, display, or storage system having the characteristic features described above which is capable of being vertically stacked in locked engagement with each other for enhancing and increasing the available space.

Other and more specific objects will in part be obvious and will in part appear hereinafter.

SUMMARY OF THE INVENTION

By employing the present invention, all of the difficulties and inabilities of the prior art are eliminated and a unique, printed, visually exciting and interest-generating, easily erected advertising/promotional display and storage system is obtained. These desirable results are achieved in the present invention by providing a unique, pre-printed housing member which is shipped or stored in a completely folded, flat configuration and quickly and easily erected from its flat, generally two-dimensional configuration into a three-dimensional promotional display and product holding member. In addition, in order to further enhance the excitement and utility generated by the promotional display and storage system of the present invention, multiple compartments are integrally formed and automatically created during the erection process of one embodiment, thereby enabling a plurality of different materials to be placed in the display system. In the second embodiment, a plurality of stackable and interchangeable members are created, thereby achieving a multi-tiered storage system, for any desired products or items.

In accordance with the present invention, in a first embodiment, a housing is provided which is constructed for being quickly and easily converted from a first, two-dimensional, flat configuration into a second, three-dimensional, fully erect, multi-compartment product holding and display system. Although prior art constructions exist for multi-compartment display systems, the present invention provides substantially enhanced features which are unique to this promotional field and product. In accordance with this embodiment of the present invention, the promotional, multi-compartment display system incorporates movable panel members and at least one foldable divider which are automatically positioned into a precisely desired location and orientation with the movement of the display member from its two-dimensional, flat configuration into its three-dimensional configuration.

In the present invention, the visually exciting, interest generating, easily employable, multi-compartment advertising/promotional display system comprises a housing incorporating a plurality of interconnected sidewalls defining the outer peripheral surface of the multi-compartment display system. In one embodiment of this invention, a generally rectangular shaped housing is created by four interconnected sidewalls members, each of which are arcuately pivotable relative to each other.

By arcuately pivoting the sidewalls 90° relative to each other, the display system is quickly and easily converted from a substantially flat, planar configuration, wherein one pair of adjacent sidewalls overlies a second pair of adjacent sidewalls, into a fully erect position wherein a first pair of substantially equivalent sidewalls is in juxtaposed, spaced, parallel relationship with each other, while a second pair of substantially equivalent sidewalls is in juxtaposed, spaced, parallel relationship with each other. In this way, the outer peripheral, sidewall-defining elements of the housing of the multi-compartment display system of the present invention are easily established.

In addition, the housing of the multi-compartment display system of the present invention also incorporates at least one interior wall member which comprises two side flaps extending from opposed edges thereof, with each of the side flaps securely affixed to opposed sidewalls of the first pair of substantially equivalent, sidewall-forming portion of the housing. In addition, the interior wall member comprises an overall width which is substantially equivalent to the width of the second pair of substantially equivalent sidewalls.

By assuring that each of the side flaps of the interior wall member are capable of being freely flexible relative to the interior wall member, the interior wall member is quickly and easily collapsed into a substantially flat, planar configuration when the housing is in its first configuration, while also being quickly and easily movable into its second, assembled position when the housing is arcuately pivoted as detailed above. When in this second position, the interior wall member is parallel to the second pair of substantially equivalent wall members, establishing an interior partition for the housing.

In addition, the housing of the multi-compartment display system of the present invention incorporates two separate and independent panel members, one of which is pivotally mounted to the interior wall member, while the second panel member is pivotally mounted to the forwardmost sidewall member which is parallel to the interior wall member. Both of these panel members are constructed for being pivoted through an arc of about 90°, from a first, upstanding, erect position, to a second, substantially planar position. Furthermore, each of these panel members extend from their respective pivot axes a distance substantially equivalent to the spaced distance between the adjacent wall member.

As a result of this construction, the panel members extend upwardly from the wall member to which they are fixed for enabling the housing to be folded in the desired, substantially flat configuration. In addition, when the housing has been arcuately pivoted into its open position, the panel members are able to articulately pivot to the assembled position, wherein each panel member forms a base or support surface for the wall member peripherally surrounded thereby. As a result, at least two separate and independent compartments are formed in which any desired display material can be easily inserted and retained.

In the preferred construction, the cooperating wall members which receive a terminating edge of the pivotable panel member incorporates a receiving slot constructed for receiving and extending tab formed along the terminating edge of the panel member. In this way, each panel member is lockingly engaged within each associated slot, providing further assurance that the support surface is securely established.

In the preferred embodiment, the visually exciting, interest generating, easily employable, multi-compartment advertising/promotional display system of the present invention also comprises an interior, rectangular shaped frame structure interconnected with the housing of the display system. In its preferred embodiment, the frame structure comprises two elongated plate members interconnected to two short plate members for establishing the frame structure, with the short plates mounted to the shorter sidewall members of the housing. In this way, an internal support system is provided for the housing, thereby adding greater rigidity and support to the panel members, when the panel members have been pivoted into their operating position.

Finally, in order to further enhance the present invention, the sidewalls, and any other desired surface, incorporate visually distinctive indicia for generating added interest and excitement to the appearance of the display. In this way, consumers are drawn to the display system of the present invention for receiving and/or purchasing the items placed therein.

In a second embodiment of the present invention, a housing is provided which is constructed for being quickly and easily converted from a first, two-dimensional, flat configuration into a second, three-dimensional, fully erect product holding and display system. As with the embodiment detailed above, in this second embodiment of the present invention, the storage/display system incorporates a plurality of interconnected sidewalls defining the outer peripheral surface of the storage/display system.

In one embodiment, a generally rectangular shaped housing is created by employing four interconnected sidewall members, each of which are arcuately pivotable relative to each other. However, any desired shaped housing can be created without departing from the scope of this invention.

By arcuately pivoting the sidewalls 90° relative to each other, the storage/and display system of this embodiment is quickly and easily converted from a substantially flat, planar configuration, wherein one pair of adjacent sidewalls overlies a second pair of adjacent sidewalls, into a fully erect position wherein a first pair of substantially equivalent sidewalls is in juxtaposed, spaced, parallel relationship with each other, while a second pair of substantially equivalent sidewalls are in juxtaposed, spaced, parallel relationship with each other. In this way, the outer peripheral sidewall defining elements for the housing of the storage/display system of the present invention are easily established.

In addition, in this embodiment of the present invention, the housing of the storage/display system also incorporates at least one interior panel member which is mounted to an inside surface of one of the sidewalls for being arcuately pivotable from a substantially vertical position to a substantially horizontal position. In this way, the interior panel member forms the floor or base of the housing, enabling any desired products to be securely positioned, retained, and stored thereon.

In the preferred construction, two interior panel members are mounted on opposed, facing sidewalls and are constructed for cooperative, overlying engagement with each other. In this way, added strength and rigidity is imparted to the overall construction, as well as providing added support for the products stored thereon.

In addition, any wall member which receives the terminating edge of the pivotable panel member incorporates a receiving slot constructed for receiving an extending tab formed along the terminating edge of the panel member. In this way, the panel member is lockingly engaged within an associated slot, providing further assurance that the support surface is securely established.

In addition, the storage/display system also comprises an interior, rectangularly shaped frame structure interconnected with the housing of the storage/display system. In the preferred embodiment, the frame structure comprises two elongated plate members interconnected to two short plate members for establishing the frame structure, with the short plate members mounted to the shorter sidewall members of the housing. In this way, an internal support system is provided for the housing, thereby adding greater rigidity and support to the panel members when the panel members have pivoted into their product retaining position.

By employing this construction, the storage/display system of this embodiment of the present invention is capable of being placed in a substantially flat, two-dimensional configuration, when desired for shipment and/or storage. In addition, the two-dimensional configuration is quickly and easily converted into the three-dimensional configuration for creating the desired storage/display system whenever needed for receiving and retaining any particular products. As detailed above, by merely pivoting the sidewalls through an arc of about 90° and then pivoting the interior panel members through an arc of about 90°, the desired three-dimensional storage/display system of the present invention is quickly and easily attained.

A further aspect of this embodiment of the present invention is the creation of an overall construction which enables a plurality of housings which form the storage/display system to be vertically mounted in locked engagement with each other. In this way, the storage capabilities of the present invention are substantially enhanced, while employing a minimum surface area on any shelf or other storage area. By constructing the storage/display system of the present invention with vertical stackability, a user is capable of enjoying substantially increased and enhanced storage capabilities, while requiring the use of a minimum surface area.

The invention accordingly comprises an article of manufacture possessing the features, properties, and relation of elements which will be exemplified in the article hereinafter described, and the scope of the invention will be indicated in the claims.

THE DRAWINGS

For a fuller understanding of the nature and objects of the invention, reference should be had to the following detailed description taken in connection with the accompanying drawings, in which.

DETAILED DISCLOSURE

By referring to FIGS. 1-12, along with the following detailed discussion, the construction and operation of alternate preferred embodiments of the present invention can best be understood. In addition, further embodiments and constructions can be implemented using the teaching of the present invention. Consequently, it is to be understood that the following detailed disclosure and the specific embodiments shown herein are provided for exemplary purposes only and are not intended as a limitation of the present invention.

In FIGS. 1-8, alternate embodiments of advertising/promotional display system 20 of the present invention are fully depicted as a multi-compartment system comprising housing 21 which, in this embodiment, comprises a generally rectangular shape. In the preferred construction of this embodiment of the present invention, housing 21 incorporates sidewalls 22, 23, 24 and 25. Each of these sidewalls are interconnected with each other along adjacent edges, forming a fully integrated assembly.

Figure 1:
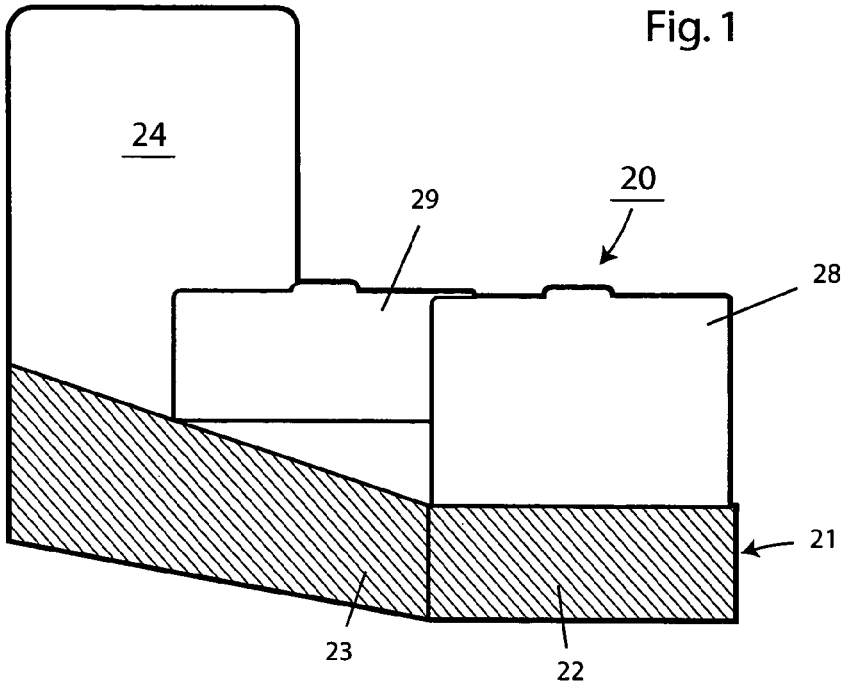
FIG. 1 is a side view depicting the multi-compartment, advertising/promotional display system of the present invention in its fully collapsed, planar configuration.
Figure 2:
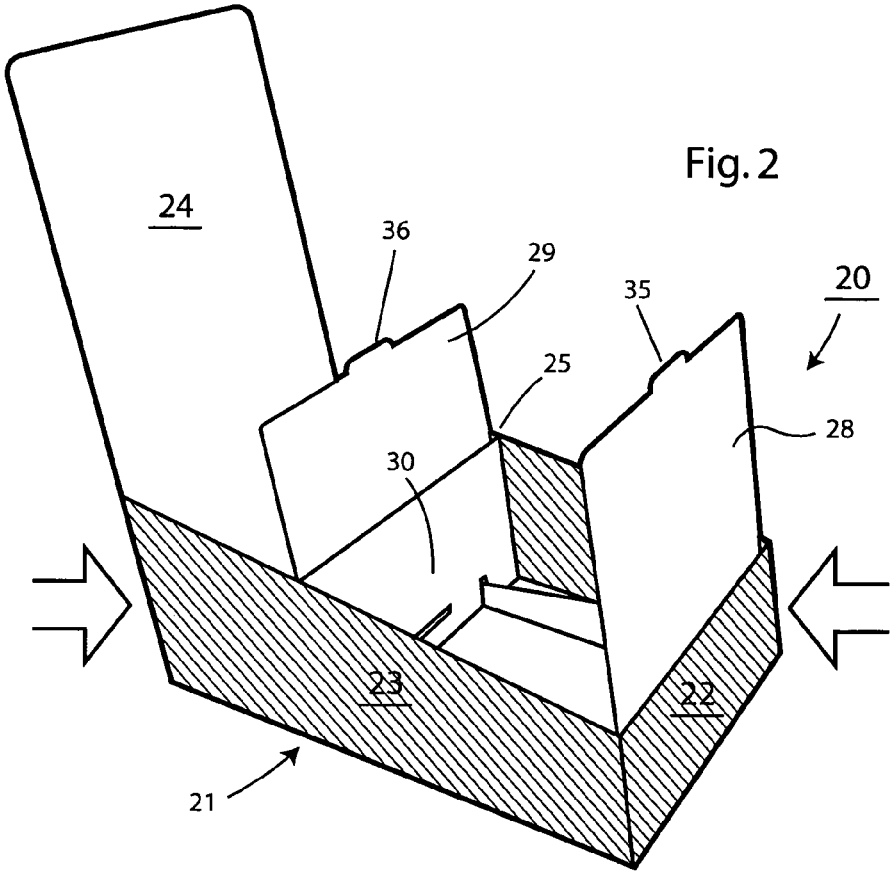
FIG. 2 is a perspective view depicting the multi-compartment, advertising/promotional display system of FIG. 1 in its partially assembled and erect position, with the sidewalls arcuately pivoted.

In FIG. 1, multi-compartment, advertising/promotional display system 20 is depicted in its fully collapsed, unfolded, generally planar configuration, with sidewalls 22 and 23 completely overlying sidewalls 24 and 25. However, by arcuately pivoting sidewalls 22, 23, 24, and 25 through an arcuate distance of about 90°, housing 21 is converted from a generally flat, two-dimensional, planar configuration to its partially assembled, three-dimensional rectangular configuration, as shown in FIG. 2.

Figure 4:
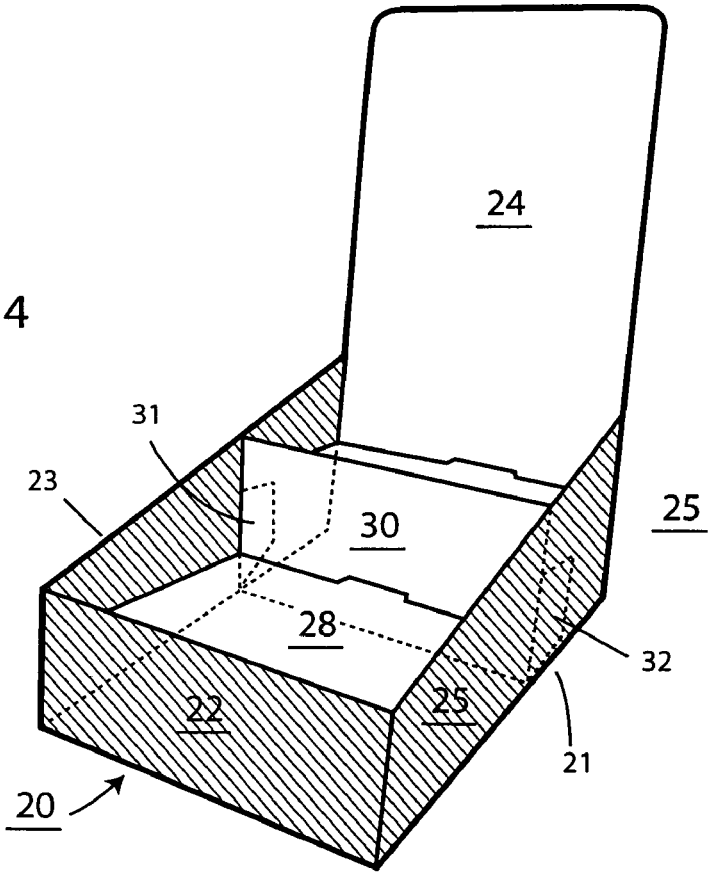
FIG. 4 is a perspective view of the multi-compartment, advertising/promotional display system of the present invention in its fully assembled configuration.

In addition, promotional, multi-compartment, advertising/promotional display system 20 incorporates movable panel members 28 and 29, and at least one foldable divider which is constructed for forming interior wall member 30. As is more fully detailed below, panel members 28 and 29 as well as interior wall member 30 are all constructed and cooperatively associated with sidewalls 22, 23, 24, and 25 for enabling all of these components to be maintained in a substantially flat, two-dimensional configuration, when multi-compartment display system 20 is in its collapsed configuration as shown in FIG. 1, and then quickly and easily converted into the fully assembled configuration, as shown in FIG. 4.

In the preferred construction of housing 21 of multi-compartment display system 20, wherein housing 21 comprises a generally rectangular shape, sidewalls 22, 23, 24, and 25 comprise two distinct pair of cooperating members. In this regard, sidewalls 23 and 25 comprise a first pair of juxtaposed, spaced, cooperating members which are maintained in parallel relationship to each other when in their erect position, while sidewalls 22 and 24 form a second pair of juxtaposed, spaced, cooperating members which are maintained in parallel relationship to each other when in their erect position.

In addition, sidewalls 22, 23, 24, and 25 may comprise any desired size, shape or configuration which satisfies the user's requirements. Typically, in this regard, sidewalls 23 and 25, which form the first pair of cooperating members, are preferably identical in size and shape, so that the sidewalls of housing 21 are identical on both sides thereof. Although preferred, the configuration is not mandatory.

Furthermore, although sidewalls 22 and 24 form the second pair of cooperating wall members, the sidewalls need not be identical in overall size and shape. As depicted, sidewalls 22 and 24 both comprise substantially identical widths, in order to enable housing 21 to be rectangular. However, sidewalls 22 comprises a substantially smaller vertical height when compared to sidewalls 24.

By employing this construction, sidewall 24 typically represents the rear panel of housing 21, enabling any desired eye-catching, visually interesting indicia to be placed thereon, for attracting consumer interest in the contents of multi-compartment display system 20. By constructing rear panel 24 with a substantially enlarged vertical height, the end-user of multi-compartment display system 20 is able to present all desired indicia and information to the consumer in a readily available, easily viewed and usable manner.

Figure 3:
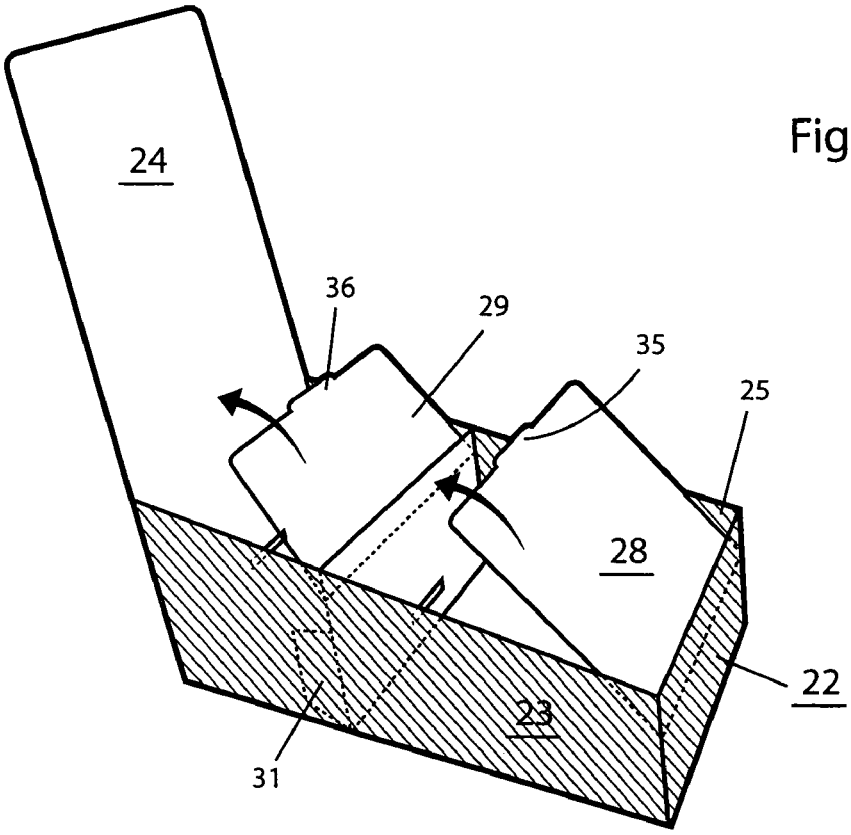
FIG. 3 is a perspective view of the multi-compartment, advertising/promotional display system of FIG. 2 with the panel members in the process of being pivoted between their first and second positions.
Figure 7:
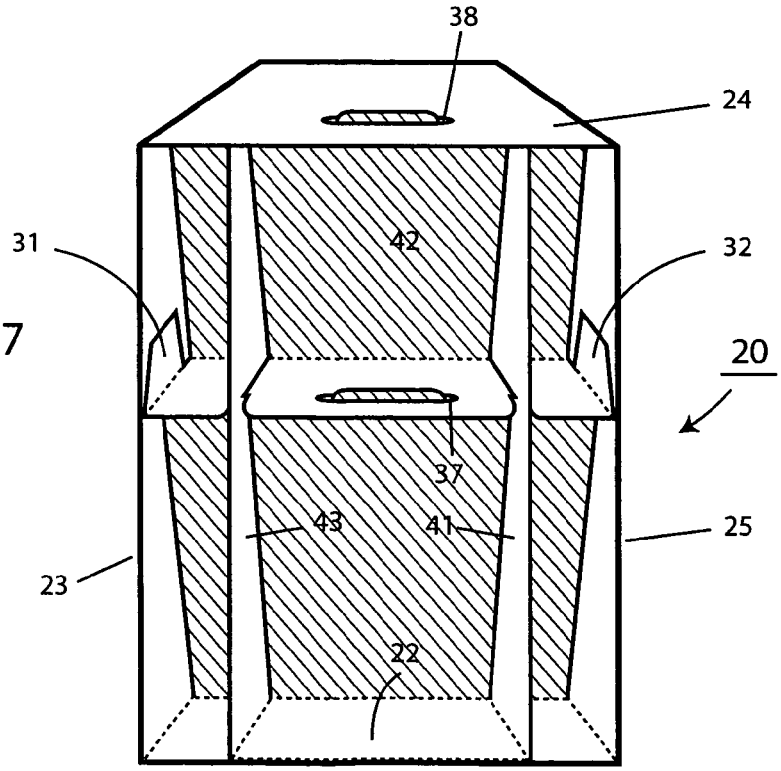
FIG. 7 is a top plan view of the multi-compartment, advertising/promotional display system of FIG. 4, with the interior panel members removed.

In the preferred construction of this embodiment of the present invention, interior wall member 30 incorporates flaps 31 and 32 affixed to opposed edges of wall member 30. As best seen in FIGS. 3, 4 and 7, flaps 31 and 32 are integrally mounted to the opposed terminating edges of interior wall member 30 in a manner which enables flaps 31 and 32 to arcuately pivot relative to interior wall member 30. In addition, flap 31 is mounted to sidewall 23, while flap 32 is mounted to sidewall 25. As a result, wall member 30 is affixed in housing 21 extending substantially midway along the overall length of sidewalls 23 and 25, establishing an interior, vertically extending wall member therein.

With flaps 31 and 32 mounted to sidewalls 23 and 25 and pivotal relative to wall member 30, display system 20 is capable of being quickly and easily moved from its substantially flat, planar configuration, depicted in FIG. 1, to the erect position depicted in FIG. 2, due to the cooperating arcuately movement of flaps 31 and 32 through an arcuate distance of 90°, simultaneously with the arcuate movement of sidewalls 22, 23, 24 and 25. In this way, the desired rectangular shaped housing 21 is quickly and easily established.

As discussed above, housing 21 of display system 20 also incorporates panel members 28 and 29. In the preferred construction, as best seen in FIGS. 2, 3, and 4, panel member 28 is mounted to sidewall 22 for pivotal movement relative thereto, between a first vertically extending, upright position, to a second, substantially horizontal position wherein panel member 28 extends from sidewall 22 to interior wall member 30. In addition, when in its second position, panel number 28 effectively forms a support base or floor for establishing a first retaining zone or first compartment in association with sidewalls 22, 23 and 25, along with wall member 30.

In addition, panel member 29 is mounted to interior wall member 30 for pivotal movement relative thereto, between a first vertically extending, upright position, to a second, substantially horizontal position wherein panel member 29 extends from wall member 30 to sidewall 24. When in its second position, panel member 29 effectively forms a support base for establishing a second retaining zone or second compartment in association with sidewalls 23, 24, and 25, along with wall member 30.

In order to assure that advertising/promotional, multi-compartment display system 20 is capable of both rapid movement from a fully collapsed, planar configuration to a fully constructed, ready to use position, panel member 28 incorporates tab element 35 formed on the top edge thereof, while panel member 29 incorporates tab element 36 formed on its top edge. In addition, interior wall member 30 incorporates elongated slot 37, while sidewall 24 incorporates elongated slot 38.

By incorporating these elements, when panel member 28 is pivoted into its second position, tab element 35 enters and engages with slot 37 of wall member 30 securing panel member 28 in the desired horizontal position. Similarly, when panel member 29 is pivoted into its second position, tab element 36 enters and engages with slot 38 of sidewall 24, securing panel member 29 in its desired horizontal position. In this way, both panel members 28 and 29 are secured and maintained in the horizontal position, whenever desired, assuring their ability to function as support surfaces for any desired material placed thereon.

Figure 5:
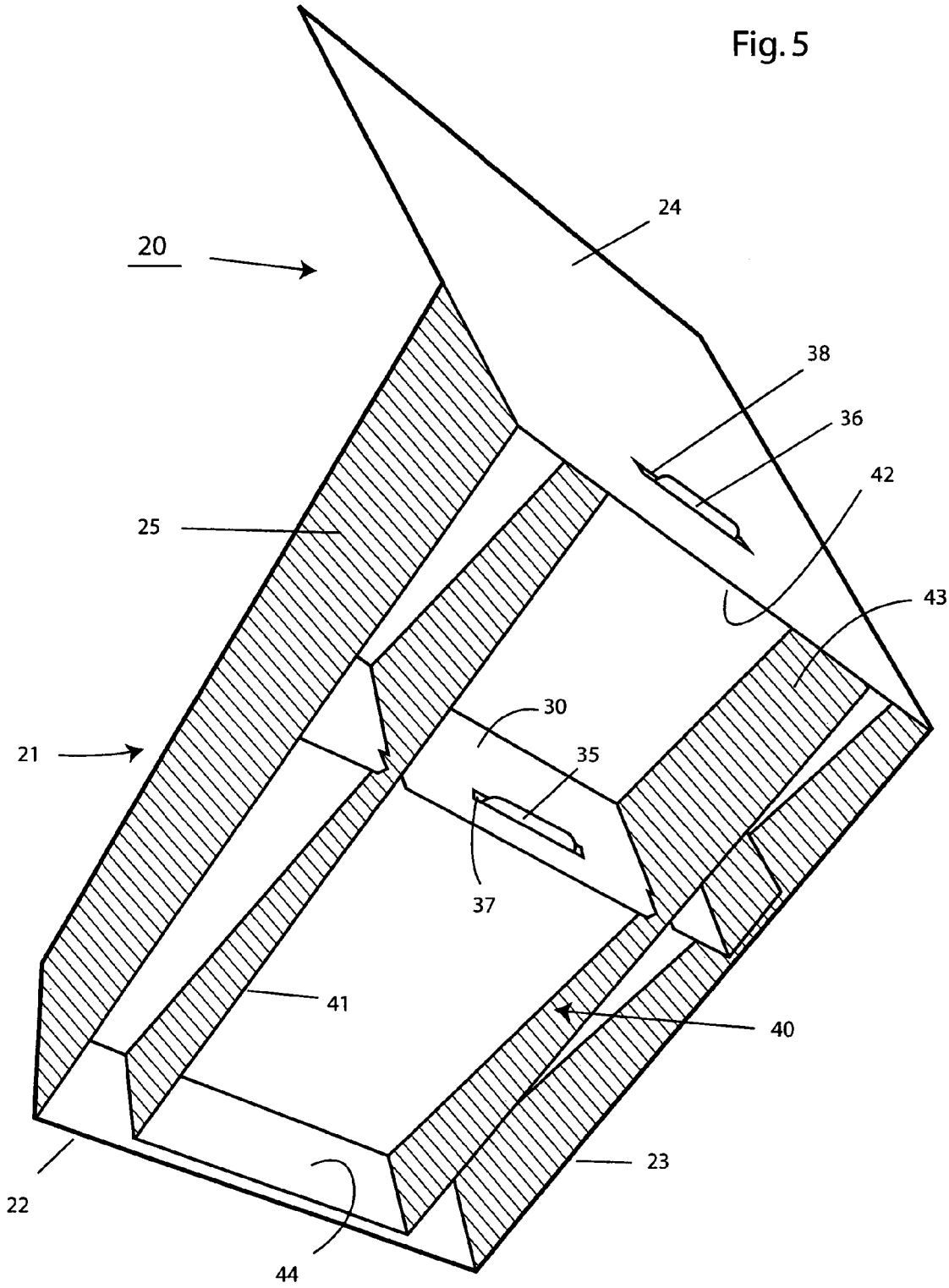
FIG. 5 is a bottom plan perspective view of the multi-compartment, advertising/promotional display system of FIG. 4.
Figure 6:
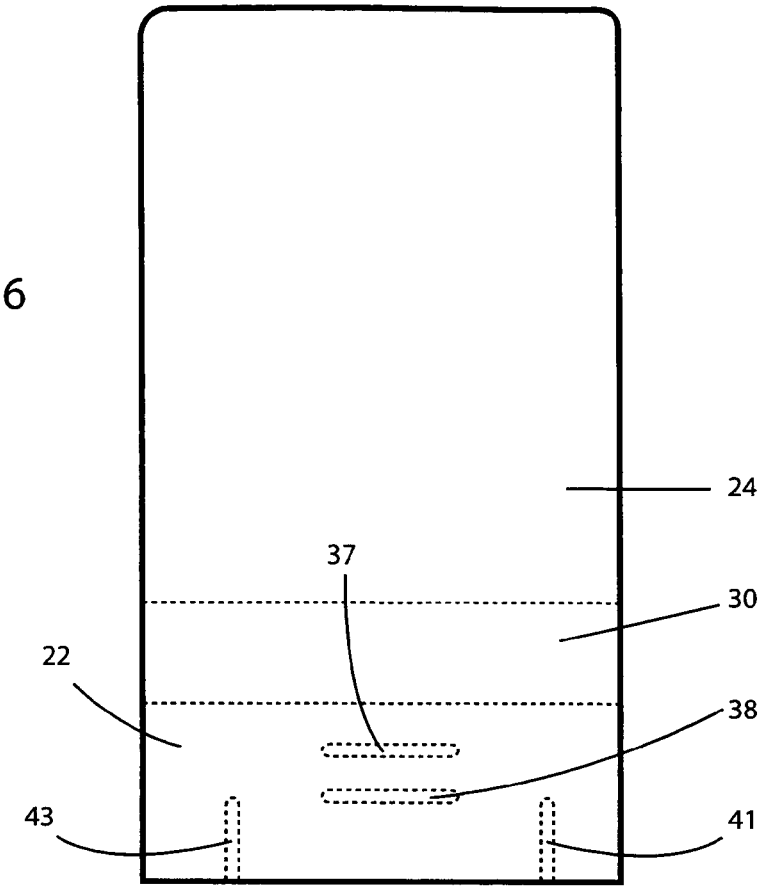
FIG. 6 is a front elevational view of the multi-compartment, advertising/promotional display system of FIG. 4.

Although the construction detailed above has been found to provide the desired multi-compartment display system which is capable of being quickly and easily transformed from its fully collapsed position to its fully erected position, ready for receiving any desired material for being retained in the compartments formed thereby, the preferred embodiment of the present invention incorporates rectangular frame structure 40 mounted to housing 21, as shown in FIG. 5. Although frame structure 40 may comprise a wide variety of alternate configurations, it has been found that a generally rectangular shape is preferred, which is formed by plate members 41, 42, 43, and 44.

As depicted, plate members 41, 42, 43, and 44 are interconnected to each other along their adjacent edges, while also been arcuately pivotable relative to each other in a manner similar to housing 21. Furthermore, frame structure 40 is securely affixed to housing 21 by bonding plate member 42 to side panel 24, and plate member 44 to side panel 22. In this way, any arcuate pivoting movement of sidewalls 22, 23, 24 and 25 simultaneously cause plate members 41, 42, 43, and 44 to arcuately pivot therewith.

In addition to adding strength and rigidity to housing 21, frame structure 40 also provides additional support to panel members 28 and 29, when panel members 28 and 29 are in their horizontal, supporting position. In this way, this preferred construction provides further assurance that any desired items placed on panel members 28 and 29 for being retained and displayed in multi-compartment system 20 will be supported, regardless of the weight of these items.

Furthermore, as best seen in FIG. 5, frame structure 40 may be constructed to impart a desired slant or tilt to support panel members 28 and 29. In this embodiment of the present invention, panel members 28 and 29 are preferably constructed for sloping downwardly as one moves from the forward to rear position. As a result, by constructing plate members 41 and 43 with the precisely desired slope angle, panel members 28 and 29 are automatically positioned, secured, and retained with the desired angular slope or tilt. Of course, if desired, panel members 28 and 29 may be maintained in a substantially flat, horizontal position or, alternatively, may be sloped or slanted in the opposite direction, by merely forming plate members 41 and 43 with the desired configuration.

Figure 8:
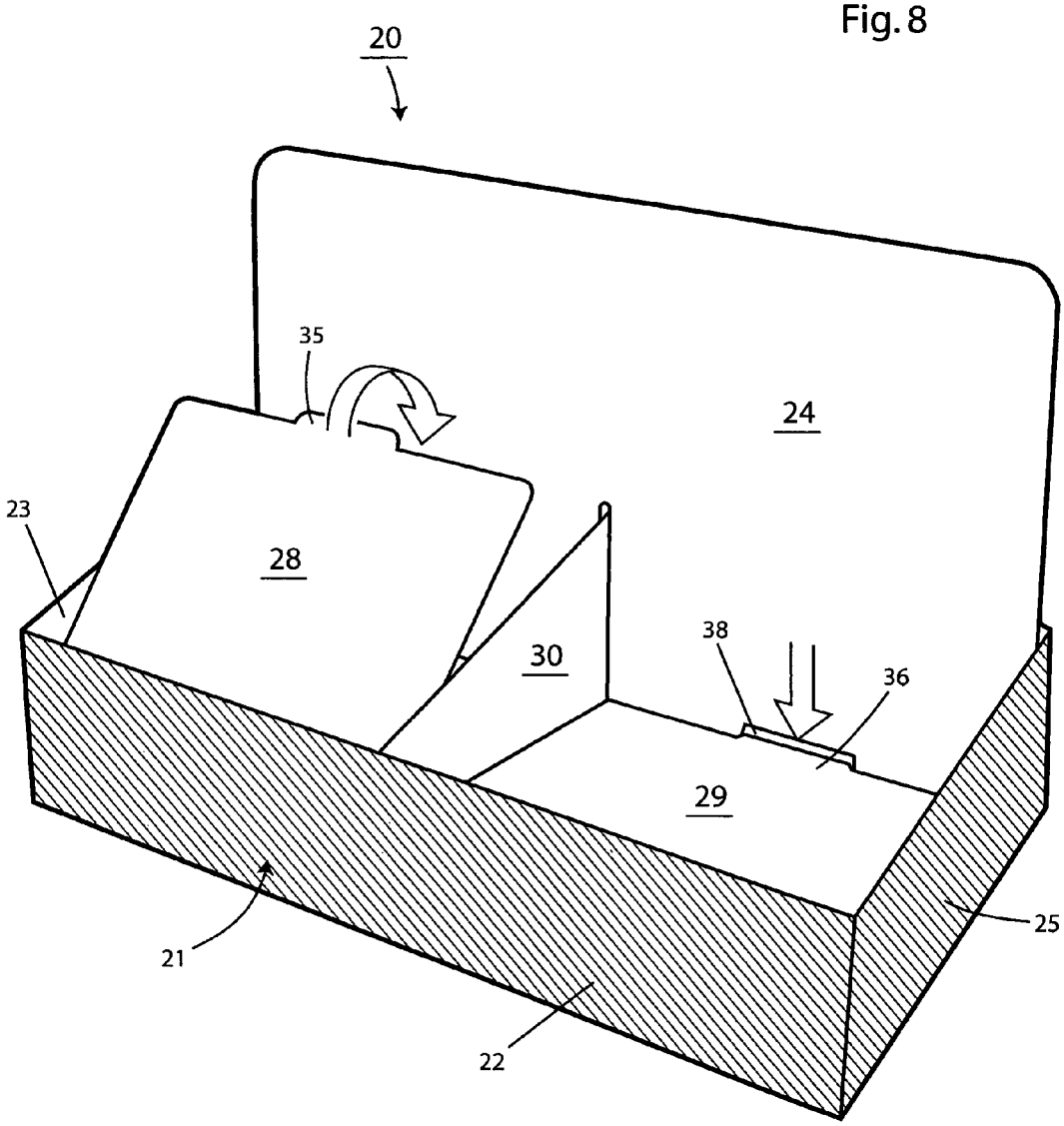
FIG. 8 is a perspective view of an alternate configuration of the multi-compartment, advertising/promotional display system of the present invention shown fully assembled.

In FIG. 8, an alternate configuration of the display/storage system of the present invention is depicted. In this configuration, housing 21 is constructed in a manner substantially identically to the construction detailed above. However, in this configuration, both panel members 28 and 29 are pivotably mounted to the same sidewall, thereby being in juxtaposed, side-to-side relationship. In addition, interior wall member 30 is positioned between panel members 28 and 29.

By employing this configuration, two substantially equivalent holding zones are formed and positioned adjacent to each other. In this way, equal access to both holding zones is achieved.

Figure 9:
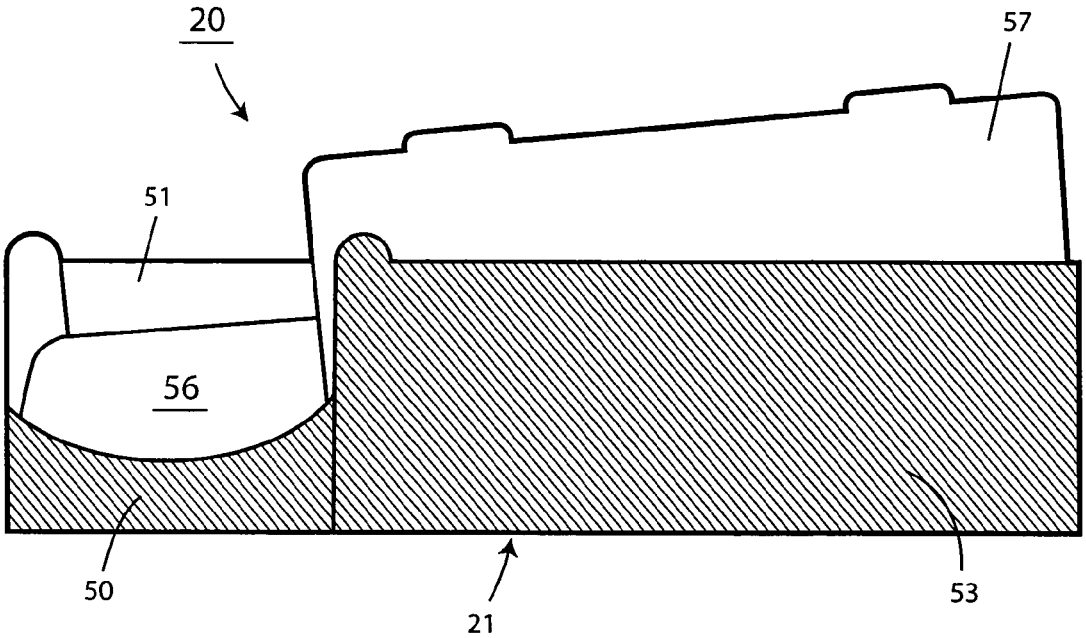
FIG. 9 is a side elevation view depicting an alternate embodiment of the advertising/promotional, display and/or storage system of the present invention in its fully collapsed, planar configuration.
Figure 10:
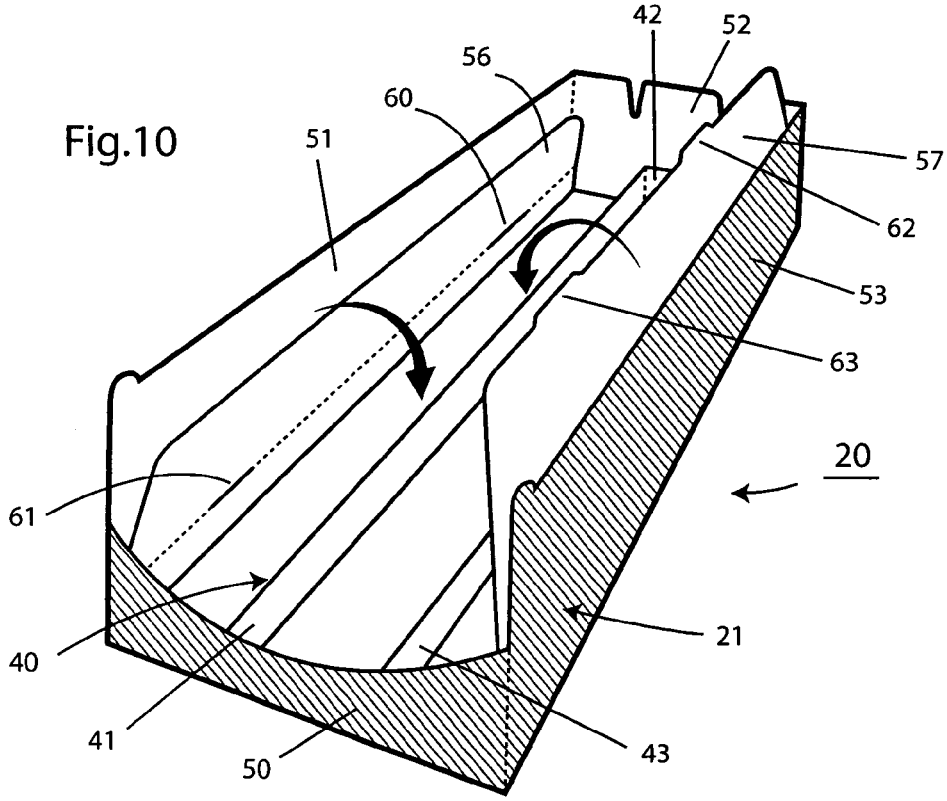
FIG. 10 is a front perspective view of the advertising/promotional, display/storage system of FIG. 9 in its partially assembled and erect position, with the sidewalls arcuately pivoted.
Figure 11:
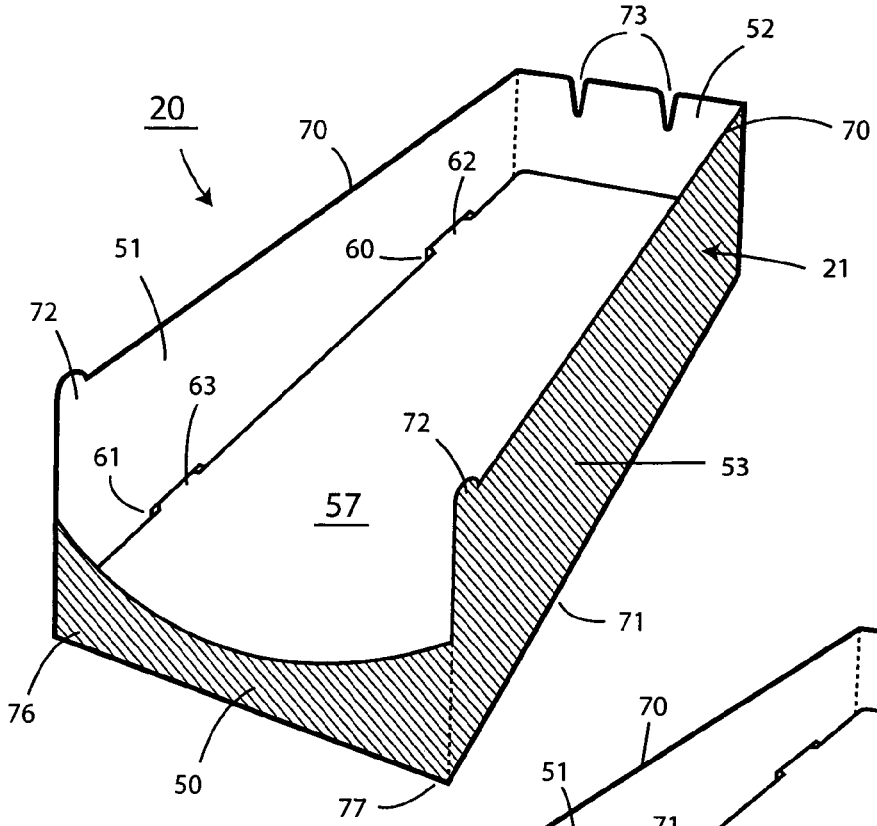
FIG. 11 is a front perspective view of the advertising/promotional, display/storage system of FIG. 9 in its fully assembled configuration.

By referring to FIGS. 9-11, along with the following a detailed discussion, an alternate embodiment of the advertising/promotional display and storage system 20 of the present invention can best be understood. As depicted, display/storage system 20 comprises housing 21 which is constructed in a generally rectangular shape. As is evident from the foregoing detailed discussion, any desired size and shaped configuration can be employed without deviating from the scope of this invention.

In this embodiment, housing 21 comprises sidewalls 50, 51, 52, and 53, each of which are interconnected with each other along adjacent edges, thereby forming a fully integrated assembly. In FIG. 9, housing 21 of display/storage system 20 is depicted in its fully collapsed, folded, generally two-dimensional, planar configuration, with sidewalls 50 and 53 completely overlying sidewalls 51 and 52. However, whenever a user desires to have display/storage system 20 in its fully assembled, three-dimensional configuration, sidewalls 50, 51, 52, and 53 are arcuately pivoted through an arcuate distance of about 90°, thereby converting housing 21 into its three-dimensional configuration, as shown in FIGS. 10 and 11.

In order to assure that fully assembled display/storage system 20 incorporates the strength and rigidity desired for holding, supporting, and retaining any desired products or items therein, housing 21 also incorporates panel members 56 and 57. In the preferred embodiment, panel member 56 is pivotally mounted along the inside surface of sidewall 51, while panel member 57 is pivotally mounted along the inside surface of sidewall 53. Although panel members 56 and 57 may be mounted to any wall member, it is a preferred that panel members 56 and 57 are mounted to the facing wall members having the greatest overall length.

In addition, panel members 56 and 57 are constructed for being arcuately pivotal through an arcuate distance of about 90°. In this way, panel members 56 and 57 are capable of being aligned in substantially the same plane as sidewalls 50, 51, 52, and 53, whenever housing 21 is in its folded, generally flat, two-dimensional, planar configuration. As a result, the desired flat, generally two-dimensional configuration is provided, along with the rapid conversion to a fully erect, three-dimensional configuration.

If desired, panel member 56 or panel member 57 is constructed with an overall width which is substantially equivalent to the width of housing 21, which is also equivalent to the overall length of sidewalls 50 and 52. In this way, assurance is provided that the entire base or floor of housing 21 is completely covered by the width of at least one panel member. As depicted, panel member 57 comprises an overall width which completely covers the base or floor of housing 21, providing the desired support thereto. If desired, both panel members 56 and 57 may comprise a substantially equivalent width. However such construction is not required.

In order to assure that fully assembled housing 21 remains completely rigid and secure in its three-dimensional configuration, sidewall 51 preferably incorporates elongated slots 60 and 61 formed therein, while panel member 57 incorporates tab extensions 62 and 63. As depicted, tab extensions 62 and 63 are constructed for being inserted and retained in slots 60 and 61 whenever panel member 57 has been arcuately pivoted into its substantially horizontal position. In this way, panel member 57 is locked in its fully assembled configuration, assuring that panel 57 remains in its horizontal position, while also strengthening and rigidifying housing 21.

In the preferred construction of this embodiment of the present invention, housing 21 of display/storage system 20 incorporates rectangular frame structure 40 mounted thereto, as best seen in FIG. 10. As with the embodiment detailed above, frame structure 40 preferably comprises a generally rectangular shape which is formed by plate members of 41, 42, 43 and 44. As depicted, and as previously detailed above, plate members 41, 42, 43, and 44 are interconnected to each other along their adjacent edges, while also being arcuately pivotable relative to each other in a manner similar to housing 21. Furthermore, frame structure 40 is securely affixed to housing 21 by bonding plate members 42 to sidewall 52 and plate member 44 to side wall 50. In this way, any arcuate pivoting movement of sidewalls 50, 51, 52, and 53 simultaneously cause plate members 41, 42, 43, and 44 to arcuately pivot therewith.

By employing frame structure 40, added strength and rigidity is imparted to housing 21, as well as providing additional support to panel members 56 and 57, when panel members 56 and 57 are in their horizontal, supporting position. In this way, the preferred construction of this embodiment of the present invention provides further assurance that any desired items placed on panel members 56 or 57 are securely retained, stored and supported thereon, regardless of the weight of these items.

In addition to providing the desired support for panel members 56 and 57, frame structure 40 may also be employed to impart a desired slope or pitch to panel members 56 and 57 by forming frame structure 40 with the desired angular slope. In the preferred construction of this embodiment of the present invention, it is preferred that panel members 56 and 57 slope forwardly, with the edge thereof adjacent panel member 50 being lower than the edge adjacent panel member 52. In this way, any items or products retained on panel members 56 and 57 will slide forwardly for ease of access through front panel member 50.

In employing this embodiment of the present invention, sidewalls 50, 51, 52 and 53 may comprise any desired size, shape, or configuration which satisfies a user's requirements. Typically, in achieving generally rectangular shaped housing 21, sidewalls 50 and 52 would comprise overall dimensions which are virtually identical or substantially similar, while sidewalls 51 and 53 are also constructed with virtually identical or similar dimensions. In this way, housing 21 incorporates a regular rectangular shape. However, as is evident to one of ordinary skill in the art, this configuration is not mandatory, and any desired configuration or alternate construction can be employed without departing from the scope of this invention.

In this regard, as depicted in FIGS. 9-12, side wall 50 incorporates a width virtually identical to the width of side wall 52, while also incorporating a height which is substantially less than side wall 52. In this way, an entry portal into the interior of housing 21 is achieved, as is further detailed below.

In this preferred construction, side walls 51 and 53 each comprise a top edge 70 and a bottom edge 71. In addition, top edge 70 and 71 of side walls 51 and 53 each comprise an upstanding flange 72, formed at the forward end thereof. Furthermore, side wall 52 incorporates a pair of generally vertically extending slots 73 formed in its top edge.

Figure 12:
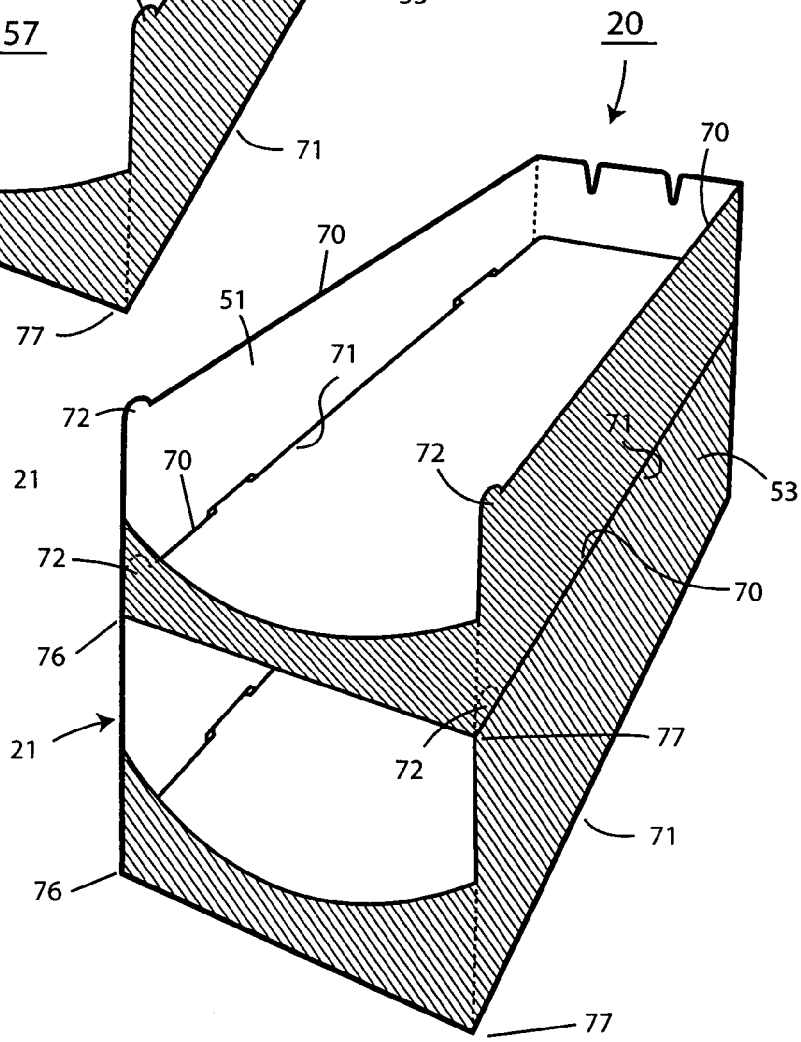
FIG. 12 is a front perspective view of the advertising/promotional, display/storage system of the present invention comprising a plurality of fully assembled housings mounted in a vertically stacked array.

As clearly depicted in FIG. 12, by employing this construction, a plurality of housings 21 can be arranged in vertically mounted, stacked, interlocked engagement with each other. In order to achieve this mounted, locked interengagement, flanges 72 of side walls 51 and 53 are positioned in locked interengagement with lower, opposed corners 76 and 77 established by panel members 51 and 53 with panel member 50. When in this position, lower edges 71 of side walls 51 and 53 of upper housing 21 is mounted in supporting contact with top edge 70 of side walls 51 and 53 of lower housing 21.

In order to provide a secure, vertically stacked construction which is free from unwanted dislodgment, an interconnecting panel is preferably employed. In this regard, the panel is inserted into slots 73 of side wall 52 and constructed for being positioned in engagement with side wall 52 of upper housing 21. In this way, the desired vertical securement of upper housing 21 with lower housing 21 is achieved.

As is evident from the foregoing detailed discussion, this embodiment of the present invention provides an easily assembled, readily achieved display and storage system 20 which is capable of being quickly and easily converted from a substantially flat, two-dimensional configuration into a product retaining, three-dimensional configuration for receiving, storing, and supporting any desired items therein. Furthermore, with the construction detailed above, a plurality of housings 21 forming display/storage system 20 are capable of being stacked in an interlock, vertical arrangement for enabling a multitude of products to be securely retained in a minimum of space or area.

It will thus be seen that the objects set forth above, among those made apparent from the preceding description, are efficiently attained and, since certain changes may be made in the above article without departing from the scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

Having described my invention, what I claim as new and desire to secure by Letters Patent is:

1. A display and/or storage system constructed for being rapidly converted from a first, flat, planar configuration to a second, substantially erect, three-dimensional configuration, said display/storage system comprising:

A. a housing comprising a plurality of interconnected sidewalls, each of said sidewalls being mounted to each other along adjacent edges;

B. each of said sidewalls being arcuately pivotable relative to the adjacent sidewall for enabling the housing to be movable from a first, flat, planar configuration to a second, erect, three-dimensional configuration; and C. an interior frame structure a) comprising a plurality of interconnected struts, at least two of said struts being mounted to sidewalls of said housing for cooperating with the sidewalls of the housing and being collapsible into a substantially flat configuration, when said housing is in its first configuration, and being readily formed into a support configuration whenever said housing is moved into its second configuration, b) each of said struts comprising a vertical height which is substantially less than the vertical height of the sidewalls, and c) being positioned in a lower portion of the housing for providing rigidity to the housing and support to a panel member when said panel member is in a second position;

D. at least one panel member a) pivotally mounted to one sidewall, b) positioned for arcuate pivoting movement from a first position, wherein said panel member lies in a plane substantially parallel with the planes of the sidewalls, to a second position wherein said panel member is peripherally surrounded by said sidewalls, is substantially perpendicular to the sidewalls for forming a support surface for retaining any desired product in the housing, and is in overlying contacting relationship with the struts forming the interior frame structure for being fully supported thereon and enabling any desirable product to be retained therein, and c) incorporating a tab portion extending from one edge thereof and a cooperating sidewall incorporates a slot formed therein, said slot being positioned for receiving and lockingly engaging the tab portion of the panel member, with said panel member being positioned in overlying contacting engagement with the struts, whereby said panel member is securely locked in a precisely desired position and fully supported on said struts whereby a display and/or storage system is obtained which is quickly and easily converted from a substantially flat, planar configuration, which is easily stored in any desired location, to a fully erect, three-dimensional configuration incorporating a housing, defined by the plurality of interconnected sidewalls, in combination with a supporting panel peripherally surrounded by sidewalls, on which any desired products can be placed.

2. The display/storage system defined in claim 1, wherein said system is further defined as comprising two cooperating panel members.

3. The display/storage system defined in claim 2, wherein said two panel members are further defined as being pivotally mounted on opposing, facing sidewalls and constructed for cooperating with each other for being in overlying relationship when arcuately pivoted into their second position.

4. The display/storage system defined in claim 2, wherein said two panel members are further defined as being pivotally mounted on the same sidewall and positioned for being aligned in a side to side relationship.

5. The display/storage system defined in claim 2, wherein said system further comprises an interior partition formed in the housing for establishing two separate and independent holding zones in the housing.

6. The display/storage system defined in claim 5, wherein said interior partition extends from a first sidewall to a second, juxtaposed, spaced, facing sidewall, and said partition incorporates wing members formed at each end thereof, said wing members being affixed to the cooperating sidewalls for securely maintaining the partition in the desired orientation, while also enabling the partition and wing members to be arcuately pivoted relative to each other for allowing the partition to be folded in a substantially flat configuration.

7. The display/storage system defined in claim 6, wherein a first panel member is pivotally mounted along a first pivot axis to one surface of the partition and a second panel member is pivotally mounted along a second pivot axis to a sidewall facing the partition when the housing is in its second configuration.

8. The display/storage system defined in claim 1, wherein at least one of said struts forming the frame structure is further defined as being constructed for receiving and maintaining the panel member in a precisely desired angular, sloping position.

9. The display/storage system defined in claim 1, wherein the sidewalls forming the housing are further defined as being constructed for cooperating with a second housing to achieve a vertically stacked and interlocked configuration.

10. The display/storage system defined in claim 9, wherein at least two sidewalls forming each housing are each further defined as comprising at least one upstanding flange formed along one edge thereof and constructed for mating, locking engagement with a receiving zone formed in the opposed edge thereof, whereby a plurality of housings are quickly and easily mounted in a vertically stacked, interlocked configuration.

11. The display/storage system defined in claim 1, wherein at least the outer surfaces of the sidewalls are further defined as comprising visually distinctive, interest generating indicia formed thereon.

12. The display/storage system defined in claim 11, wherein one of said sidewalls comprises an enlarged, vertically extending configuration, for effectively forming a rear panel of the housing and incorporates visually distinctive and interest generating indicia printed thereon for attracting consumers to said display/storage system.

13. A display and/or storage system constructed for being rapidly converted from a first, flat, planar configuration to a second, substantially erect, three-dimensional configuration, said display/storage system comprising:

A. a housing comprising a plurality of interconnected sidewalls, each of said sidewalls being mounted to each other along adjacent edges;

B. each of said sidewalls being arcuately pivotable relative to the adjacent sidewall for enabling the housing to be movable from a first, flat, planar configuration to a second, erect, three-dimensional configuration;

C. an interior frame structure a) comprising a plurality of interconnected struts, at least two of said struts being mounted to sidewalls of said housing for cooperating with the sidewalls of the housing and being collapsible into a substantially flat configuration, when said housing is in its first configuration, and being readily formed into a support configuration whenever said housing is moved into its second configuration, and b) being positioned in a lower portion of the housing for providing rigidity to the housing and support to a panel member when said panel member is in its second position;

D. at least two panel members, each being a) pivotally mounted at least one sidewall, b) positioned for arcuate pivoting movement from a first position, wherein said panel member lies in a plane substantially parallel with the planes of the sidewalls, to a second position wherein said panel member is peripherally surrounded by said sidewalls; and is in overlying contacting engagement with the struts forming the interior frame structure for being fully supported thereon; and E. at least one of the panel members incorporating a first tab portion extending from the edge thereof opposite a first pivot axis and a cooperating sidewall incorporates a first slot formed therein, said first slot being positioned in overlying relationship with the struts, whereby said at least one of the panel members is securely locked in a precisely desired position and fully supported on said struts, whereby a display and/or storage system is obtained which is quickly and easily converted from a substantially flat, planar configuration, which is easily stored in any desired location, to a fully erect, three-dimensional configuration incorporating a housing, defined by the plurality of interconnected sidewalls, in combination with a supporting panel peripherally surrounded by sidewalls, on which any desired products can be placed.

14. The display/storage system defined in claim 13, wherein at least one of said struts forming the frame structure is further defined as being constructed for receiving and maintaining the panel member in a precisely desired angular, sloping position.

15. The display/storage system defined in claim 14, wherein said at least two panel members are further defined as being pivotally mounted on opposing, facing sidewalls and constructed for cooperating with each other for being in overlying relationship when arcuately pivoted into their second position.

16. The display/storage system defined in claim 14, wherein said at least two panel members are further defined as being pivotally mounted on the same sidewall and positioned for being aligned in a side to side relationship.

17. The display/storage system defined in claim 13, wherein the other of the at least two panel members is further defined as incorporating a second tab portion extending from the edge thereof opposite the second pivot axis and a cooperating surface of the partition incorporates a second slot formed therein, said second slot being positioned for receiving and lockingly engaging the second tab portion of the other of the at least two panel members with said other of the at least two panel members being positioned in overlying contacting engagement with the struts, whereby the other of the at least two panel members is securely locked in a precisely desired position and fully supported on said struts.

* * * * *